US009187196B2

(12) United States Patent
Bencista'Falorni et al.

(10) Patent No.: US 9,187,196 B2
(45) Date of Patent: Nov. 17, 2015

(54) TAP FOR BEVERAGE DISPENSING FROM RECEPTACLES SUCH AS BOTTLES AND THE LIKE

(75) Inventors: Lorenzo Bencista'Falorni, Greve in Chianti (IT); Massimiliano Rubino, Prato (IT); Francesco Panichi, San Polo in Chianti (IT)

(73) Assignee: ENOMATIC S.R.L., Greve in Chianti (IT)

( * ) Notice: Subject to any disclaimer, the term of this patent is extended or adjusted under 35 U.S.C. 154(b) by 339 days.

(21) Appl. No.: 13/806,835

(22) PCT Filed: Jun. 28, 2011

(86) PCT No.: PCT/EP2011/060790

§ 371 (c)(1),
(2), (4) Date: Dec. 24, 2012

(87) PCT Pub. No.: WO2012/000978

PCT Pub. Date: Jan. 5, 2012

(65) Prior Publication Data

US 2013/0098499 A1 Apr. 25, 2013

(30) Foreign Application Priority Data

Jun. 29, 2010 (IT) ..... FI2010A0138

(51) Int. Cl.

| | |
|---|---|
| ***B65B 31/04*** | (2006.01) |
| ***B67D 1/00*** | (2006.01) |
| ***B67D 1/04*** | (2006.01) |
| ***B67D 1/07*** | (2006.01) |
| ***B67D 1/12*** | (2006.01) |

(52) U.S. Cl.

CPC ..... *B65B 31/047* (2013.01); *B67D 1/0085* (2013.01); *B67D 1/04* (2013.01); *B67D 1/07* (2013.01); *B67D 1/12* (2013.01); *B67D 1/125* (2013.01); *B67D 2001/0098* (2013.01); *B67D 2001/0481* (2013.01)

(58) Field of Classification Search

CPC .. B67D 1/0412; B67D 1/0885; B67D 1/0829; B67D 1/0085; B67D 2001/0481; B67D 7/0266

USPC ..... 141/14, 17, 64, 67, 89–91; 222/400.7, 222/399, 152

See application file for complete search history.

(56) References Cited

U.S. PATENT DOCUMENTS

| | | | | |
|---|---|---|---|---|
| 3,993,218 | A * | 11/1976 | Reichenberger | 222/30 |
| 4,702,396 | A * | 10/1987 | Gwiazda | 222/152 |
| 7,478,737 | B2 * | 1/2009 | Gosi et al. | 222/148 |
| 2010/0276453 | A1 * | 11/2010 | Vandaele | 222/152 |

* cited by examiner

*Primary Examiner* — Timothy L Maust
*Assistant Examiner* — Timothy P Kelly
(74) *Attorney, Agent, or Firm* — Abelman, Frayne & Schwab

(57) ABSTRACT

The present invention relates to a device for dispensing beverages from receptacles such as bottles and the like, characterized by a dispensing unit comprising a tap (10) adapted to clean all the zones involved in the circulation of the beverage, thus limiting the consumption of inert gas required for this operation, by employing two separate modules for managing the beverage dispensing and for managing the inert gas emission.

5 Claims, 1 Drawing Sheet

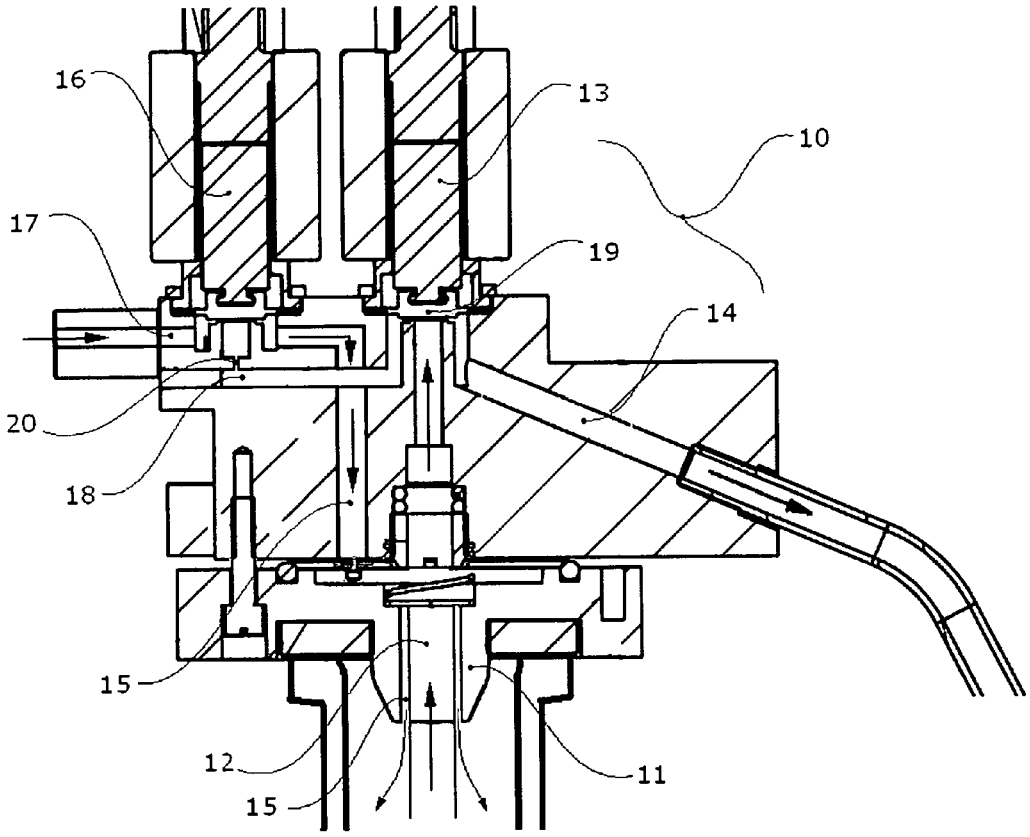
16
13
10
17
19
14
20
18
15
12
15
11

TAP FOR BEVERAGE DISPENSING FROM RECEPTACLES SUCH AS BOTTLES AND THE LIKE

FIELD OF THE INVENTION

The present invention relates to the field of devices and apparatuses for automatically dispensing beverages. In particular, it relates to the field of devices for dispensing beverages from bottles and similar receptacles.

BACKGROUND

Devices and apparatuses adapted to automatically dispense beverages from containers such as bottles and the like are known in the art. Some of these devices and apparatuses maintain the bottles or similar receptacles in an upside down position and dispense the beverage contained therein by suitably opening a valve which allows the beverage to fall by gravity into a container conveniently positioned at the mouth of the receptacle itself.

Other known devices keep the bottles, or similar receptacles, in an upright vertical position, resting on their bottom, and dispense the beverage by means of two tubes introduced into the bottle through the cap of the bottle itself. An inert gas is pressurized into the bottle through one of the aforesaid tubes thus keeping the beverage pressurized. When the dispensing tap associated with a tube is opened, the pressurized gas allows the beverage to be dispensed through the other tube. Devices and apparatuses of this second type are particularly suitable in all those cases, such as for example in the case of wine, in which the beverage contained in the bottle would suffer a decline of its organoleptic quality due to the upside down position of the bottle itself.

However, the devices and apparatuses from the state of the art have drawbacks and limitations which prevent the distribution and a more widespread use thereof.

In the case of devices adapted to dispense beverages from containers kept in vertical or standing position, one of the most common problems relates to the level of cleanliness of the dispensing tube, which is often insufficient to ensure the complete suppression of the problem related to possible beverage residues in the tube when subsequently dispensing.

Patent number IT1352873 describes an apparatus for dispending beverages from containers kept in a vertical or standing position, comprising a tapping unit consisting of a main body comprising a solenoid valve and a tap adapted to engage with the neck of the bottle from which the beverage is to be tapped by means of a conical mouth. A first conduit adapted to allow the inert gas to enter into the bottle, and a second conduit in which the tapped beverage flows and is connected to the dispensing spout, are inside the tap. The second conduit has a chamber closed by the plunger of the solenoid valve and a branch connected to the inert gas circuit.

During operation, the pressurized gas contained in the bottle will push the liquid through the second conduit and the chamber up to the dispensing spout where it will be collected by the user.

Once the preset quantity of liquid has been tapped, the solenoid valve closes and, after a short time span required to allow the liquid remaining in the second conduit to flow downstream of the branch, a gas jet is blown through the branch, which allows all the remaining liquid drops to be completely eliminated in the second conduit and in the spout.

This embodiment requires the presence of two separate circuits for pressurizing the gas, one of which intended to dispense the beverage and the other one intended to emit the jet for cleaning the dispensing tube once the dispensing itself has been occurred. The two separate circuits have different pressures and thus constitute two devices for adjusting the gas pressure. This construction is complex, costly, and subject to gas leakages if not appropriately maintained by preventive maintenance and checking.

Moreover, such construction requires that, during dispensing, the beverage travels within the described chamber, which chamber is not involved with the cleaning jet and, in the case of beverages coming up against organoleptic degeneration such as wine, may cause problems for the subsequent dispensing operations.

Therefore, when using a dispensing unit with beverage dispensing devices it should be constructed to overcome the described drawbacks while allowing the construction to be simplified by introducing a single gas pressurizing circuit. Preferably, such unit has two valves and a single reducer, thereby decreasing the complexity and cost of the construction as well as the incidence of gas leakages.

SUMMARY OF THE INVENTION

The present invention relates to a device for dispensing beverages from receptacles such as bottles and the like, characterized by a dispensing unit comprising a tap adapted to clean all the zones involved in the circulation of the beverage, while limiting the consumption of inert gas required for this operation by employing two separate circuits for managing the beverage dispensing and for managing the inert gas emission.

BRIEF DESCRIPTION OF THE DRAWINGS

FIG. 1: Sectional view of the device according to the present invention.

DETAILED DESCRIPTION OF THE INVENTION

With reference to the accompanying drawings, the device according to the present invention includes a tap unit 10, adapted to engage the opening of a bottle or similar receptacle for beverages, and to adjust the discharge therefrom of the beverage contained therein. The tap unit 10 has a first circuit associated with the beverage dispensing operation, and a second circuit associated with the inert gas pressurization, wherein each circuit has a solenoid valve.

In greater detail, the tap unit 10 includes an element 11, preferably with a truncated conical shape, adapted to engage the opening of the receptacle from which the beverage is to be tapped. The element 11 further includes a first circuit associated with the beverage dispensing and a second circuit associated with the inert gas pressurization. The first circuit in turn includes: a first channel 12 which crosses the element 11 and is adapted to withdraw the beverage to be dispensed from the receptacle; a first solenoid valve 13, associated with one end of the first channel 12 and with a second channel 14 adapted to dispense the beverage. The second circuit in turn includes: a third channel 15, which also crosses the element 11 and is adapted to conduct the inert gas towards the interior of the receptacle containing the beverage to be dispensed; a second solenoid valve 16, associated with one end of the third channel 15 and with a fourth channel 17, associated with external dispenser for providing inert gas to the tap unit; a fifth channel 18 associated with both solenoid valves 13, 16 and connected to the second solenoid valve 16 by a pressure reducing unit 20.

During regular operation, inserting the bottle so as to engage the opening thereof with the element 11 enables the inert gas to flow from the dispenser towards the receptacle of the beverage to be dispensed.

The inert gas enters into the receptacle causing the discharge of the beverage from the receptacle, which first fills the first channel 12 up to the first solenoid valve 13 and then, when the first solenoid valve 13 opens, is dispensed into the user's cup through the second channel 14.

Once the dispensing step has been completed by closing the first solenoid valve 13, the solenoid valve 16, through the second circuit, allows the second channel 14 to be cleaned: the first solenoid valve 13 switches its status thus stopping the beverage dispensing by closing the first channel 12, which is thus disconnected from the second dispensing channel 14. In this step, the first solenoid valve 13 closes the first channel 12 by means of a specific membrane 19 of the so-called "total separation" type, which contacts the opening of the first channel 12, associated with the solenoid valve 13.

Thus, an inert gas jet is directed towards the dispensing spout through the pressure reducer 20, the fifth channel 18 and second channel 14 having a lower pressure (e.g. by 100 times) as compared to the pressure used for dispensing the beverage. This low pressure jet is more than enough to perfectly clean the beverage dispensing channels and all the parts involved by the beverage travel, while avoiding an extra consumption of inert gas.

In a preferred embodiment of the present invention, the pressure of the inert gas employed is lowered from 0.16 bars (employed for dispensing the beverage) to 0.0016 bar (employed in the step of cleaning the dispensing channels).

Moreover, the pressure reducer 20 preferably has a conduit of suitable diameter, adapted to abate the pressure value of the travelling gas to the value desired.

The invention claimed is:

1. A device for dispensing beverages from receptacles comprising a tap unit adapted to engage with the opening of a bottle or similar receptacle for beverages and to adjust, by means of an outlet channel, the discharge of the beverage contained in said receptacle by pressurising with gas, said tap comprising a first circuit in fluid communication with beverage delivery and a second circuit in fluid communication with inert gas pressurisation, both circuits being in fluid communication, in turn, with an element adapted to engage the opening of the receptacle from which the beverage is tapped, wherein said first circuit is in fluid communication with a first solenoid valve and said second circuit is in fluid communication with a second solenoid valve and with pressure reducing means and wherein said first circuit comprises:

a first channel which runs through said element and is adapted to withdraw the beverage to be dispensed from said receptacle and a first solenoid valve, in fluid communication with one end of said first channel and with a second channel adapted to dispense the beverage, and wherein said second circuit comprises:

a third channel, which runs through said element and is adapted to conduct inert gas towards the interior of the receptacle containing the beverage to be dispensed;

a second solenoid valve, in fluid communication with one end of said third channel and with a fourth channel, in fluid communication with an external inert gas container;

a fifth channel in fluid communication with both said solenoid valves and connected to said second solenoid valve by means of said pressure reducing means.

2. The device according to claim 1, wherein said pressure reducing means comprise a conduit of appropriate diameter adapted to reduce the pressure value of the travelling gas to the value desired.

3. The device according to claim 1, wherein said pressure reducing means are adapted to reduce the pressure by a factor of 100.

4. The device according to claim 1, wherein said first solenoid valve is a total isolation solenoid valve.

5. The device according to claim 1, wherein said element adapted to engage the opening of the receptacle from which the beverage is tapped, is cone frustum shaped.

* * * * *